US006113396A

United States Patent [19]

Tung

[11] Patent Number: 6,113,396

[45] Date of Patent: Sep. 5, 2000

[54] ELECTRICAL CONNECTOR

[75] Inventor: Shun-Chi Tung, Tu-Chen, Taiwan

[73] Assignee: Hon Hai Precision Ind. Co., Ltd., Taipei Hsien, Taiwan

[21] Appl. No.: 09/304,124

[22] Filed: May 3, 1999

[30] Foreign Application Priority Data

Dec. 22, 1998 [TW] Taiwan ..... 87221342

[51] Int. Cl.[7] ..... H01R 12/00

[52] U.S. Cl. ..... 439/62; 439/637

[58] Field of Search ..... 439/62, 60, 59, 439/630, 636, 637

[56] References Cited

U.S. PATENT DOCUMENTS

| | | | |
|---|---|---|---|
| 4,869,672 | 9/1989 | Andrews, Jr. | 439/60 |
| 4,934,961 | 6/1990 | Piorunneck et al. | 439/59 |
| 5,052,936 | 10/1991 | Biechler et al. | 439/60 |
| 5,112,231 | 5/1992 | Harwath et al. | 439/60 |
| 5,162,002 | 11/1992 | Regnier | 439/60 |
| 5,800,203 | 9/1998 | Pratt et al. | 439/60 |
| 5,820,392 | 10/1998 | Lin et al. | 439/60 |

*Primary Examiner*—Tulsidas C Patel
*Attorney, Agent, or Firm*—Wei Te Chung

[57] ABSTRACT

An electrical connector comprises an insulative housing defining a number of passageways as well as a mating face, and a number of conductive terminals received in the corresponding passageways. Each terminal includes a contact section, a securing section and a joint section. The contact sections of the terminals each have a first crook connected to a second or contact crook by a connecting section. The terminals comprise both long terminals and short terminals arranged in the housing in two rows. The long terminals are alternately arranged with the short terminals whereby the electrical connector can clippingly engage with a PCB while exhibiting the advantages of quick assembly at low cost.

10 Claims, 5 Drawing Sheets

ELECTRICAL CONNECTOR

BACKGROUND OF THE INVENTION

The present invention relates to an electrical connector, and especially to an electrical connector having terminals clippingly assembled to a printed circuit board (PCB) without any auxiliary framework.

Conductive terminals of conventional electrical connectors are usually soldered onto a PCB by applying Through Hole Technology (THT). The deficiencies of THT are apparent since damage to either the circuit structure of the PCB or the conductive terminals of the electrical connector may occur thereby complicating the manufacturing process and increasing costs during assembly. In order to overcome the deficiencies of THT, a Surface Mount Technology (SMT) has been introduced. However, the SMT employs at least one auxiliary framework and/or connector. Traditional electrical connectors mounted to a PCB by SMT generally have two or more rows of conductive terminals having ends or tails extending to a PCB for SMT. Because the terminals are often densely arranged, it complicates mass-production and threatens the necessary coplanar relationship of the terminals. Thus, signal transmission between the electrical connector and the PCB may be adversely affected. Furthermore, if an auxiliary framework or connector is used, not only will increase the cost due to the addition of components and related procedures, but the space on the PCB occupied by the additional components will also be increased.

SUMMARY OF THE INVENTION

The primary purpose of the present invention is to provide an electrical connector having conductive terminals which clippingly engage with a PCB.

The second purpose of the present invention is to provide an electrical connector having conductive terminals for mechanically contacting a PCB at different times thereby reducing mating resistance and expediting assembly.

In order to achieve the purposes set forth, an electrical connector in accordance with the present invention comprises a housing defining a number of passageways therein and a mating face for electrically mating with a PCB. A corresponding number of conductive terminals are received in the passageways. Each terminal has a contact section, a securing section and a joint section. The terminals are arranged into at least an upper row and a lower row with a long terminal being alternately arranged with a short terminal in each row. Furthermore, the contact section of each terminal can clippingly engage the PCB thereby completing assembly without requiring any auxiliary components.

According to one aspect of the present invention, an alternative arrangement of the long and short terminals enables the PCB to electrically contact the terminals of the upper row and the lower row at different times, thereby reducing the mating resistance during assembly of the electrical connector to the PCB.

According to another aspect of the present invention, the terminals of the upper row and the lower row are arranged whereby each long terminal is paired with a shorter terminal in a column for enabling contact between the PCB and the terminals of the upper and lower rows to occur at different time. Thus, mating resistance experienced during assembly can be effectively reduced.

DETAILED DESCRIPTION OF THE PREFERRED EMBODIMENT

Figure 1:
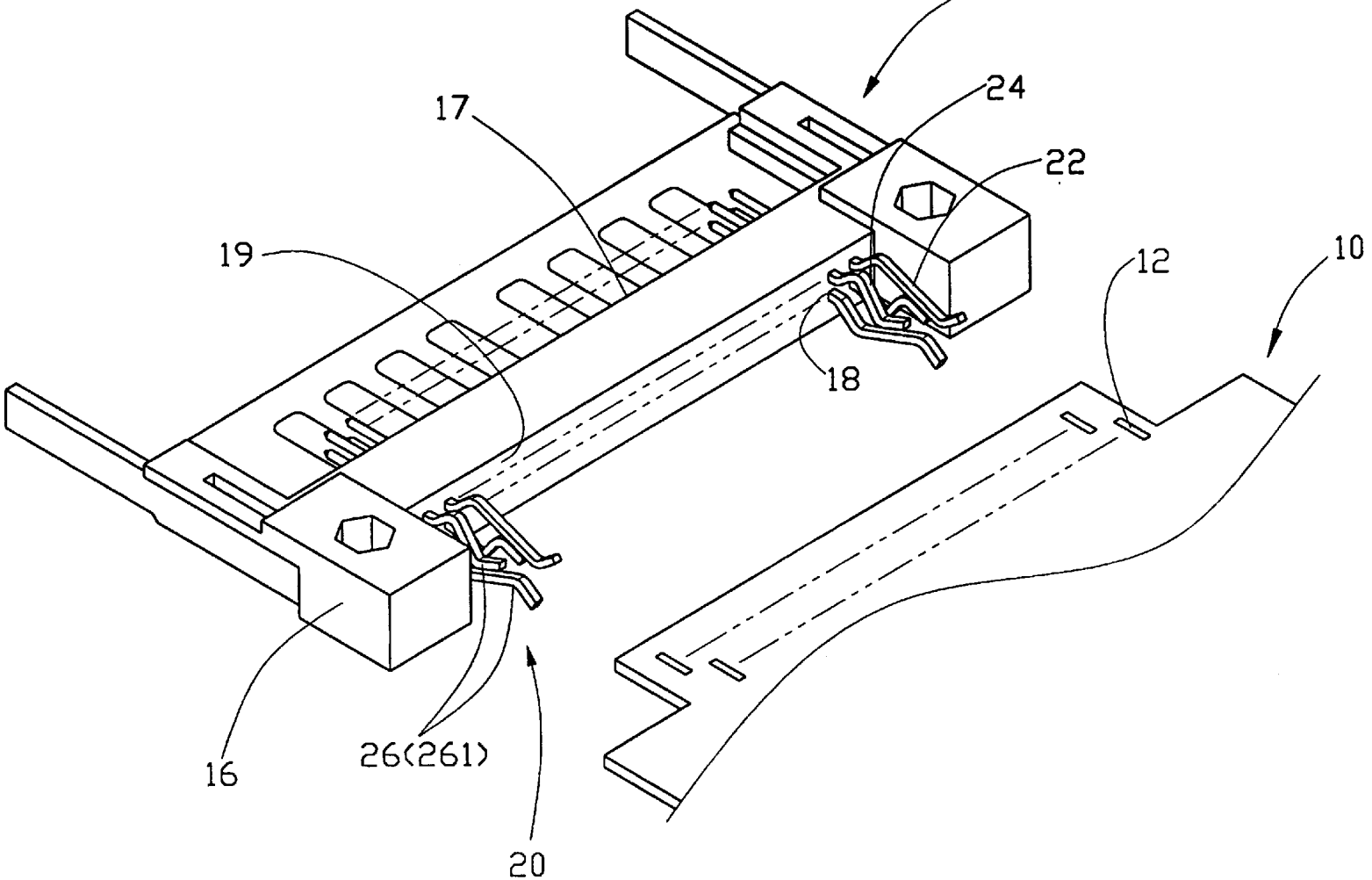
FIG. 1 is a perspective view of an electrical connector in accordance with a first embodiment of the present invention and a PCB.
Figure 2A:
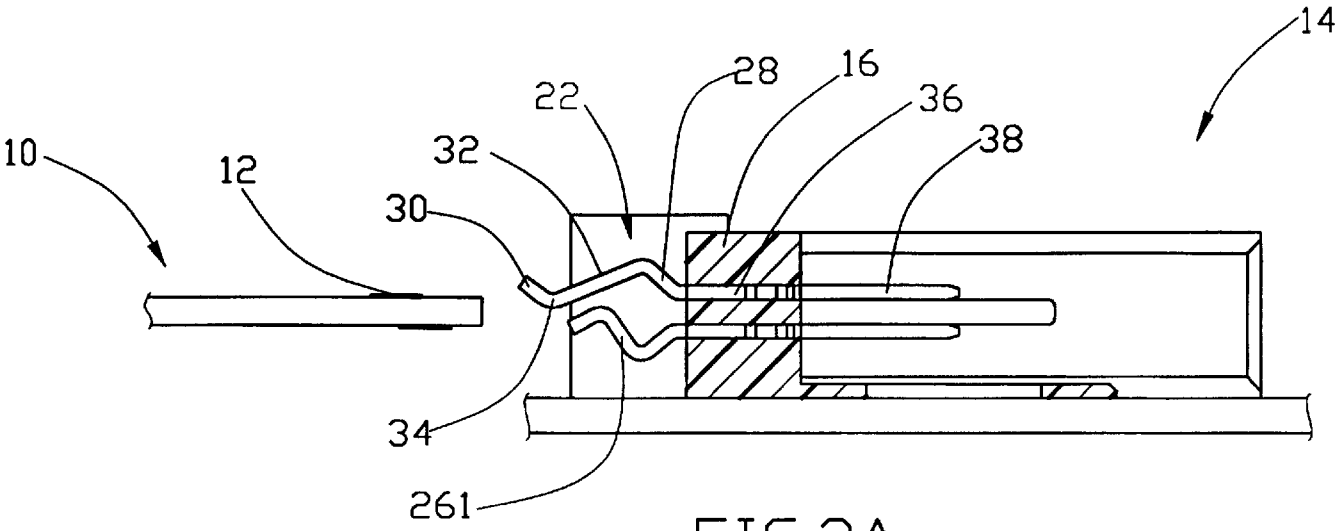
FIG. 2A is a cross-sectional view of the electrical connector and the PCB before assembly.
Figure 2B:
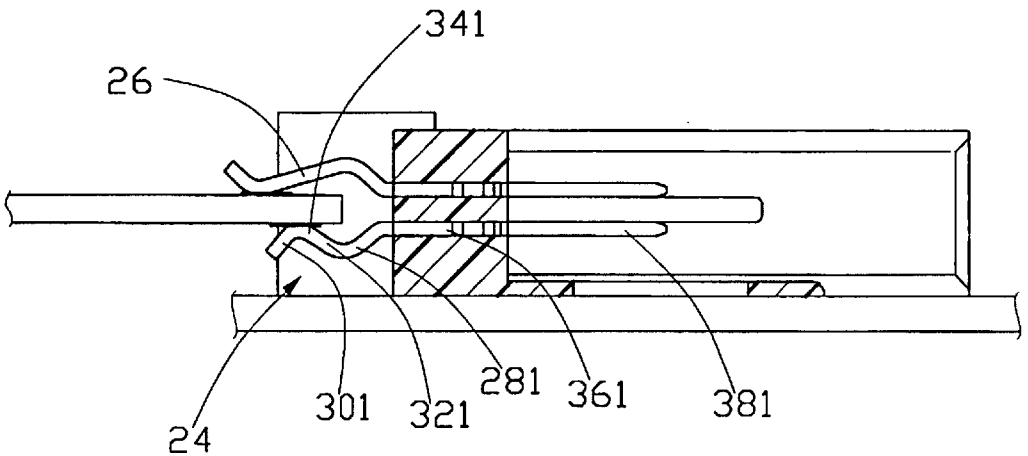
FIG. 2B is a cross-sectional view of the electrical connector and PCB after assembly.
Figure 3A:
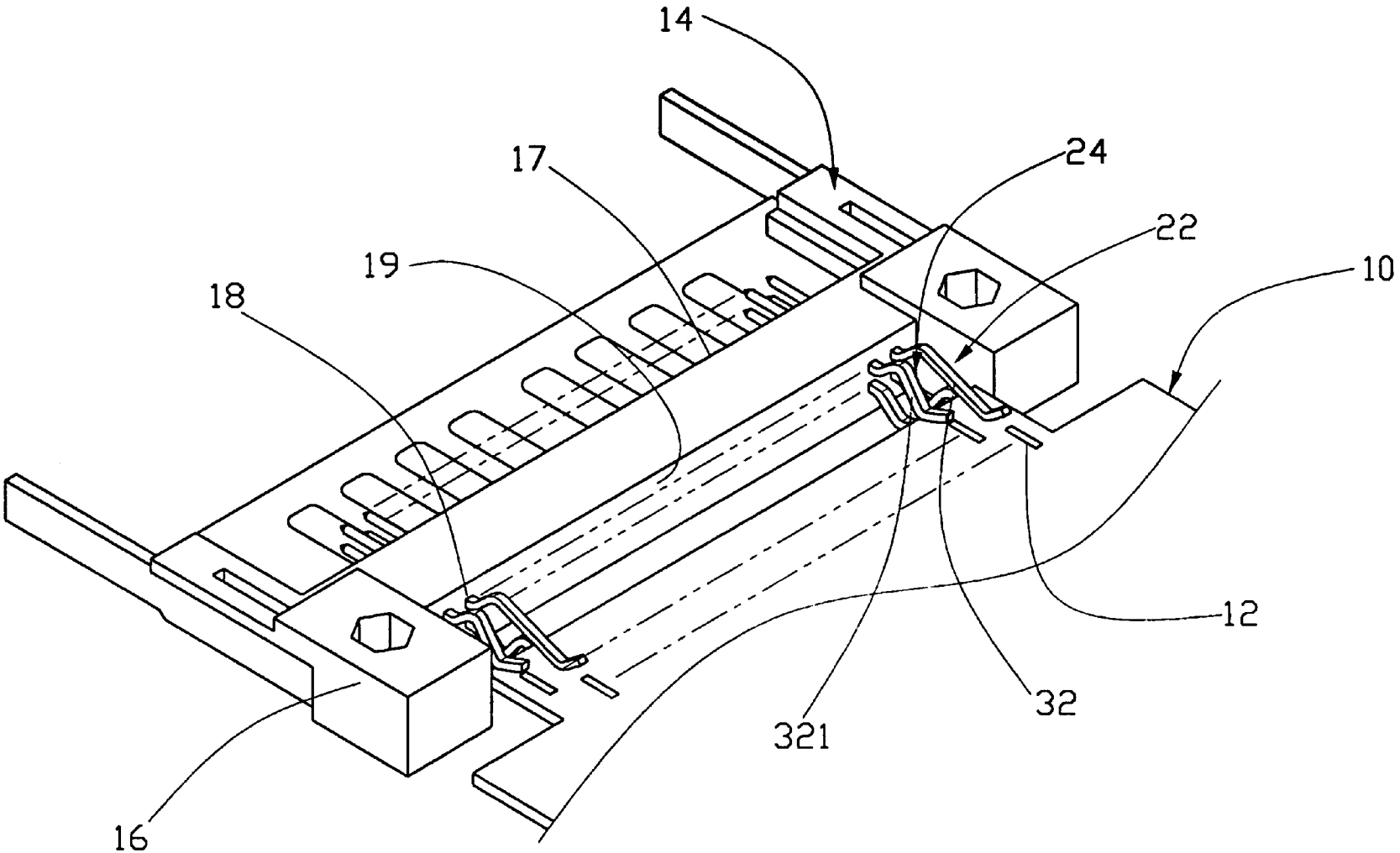
FIG. 3A is a perspective view of the electrical connector and PCB before assembly.
Figure 3B:
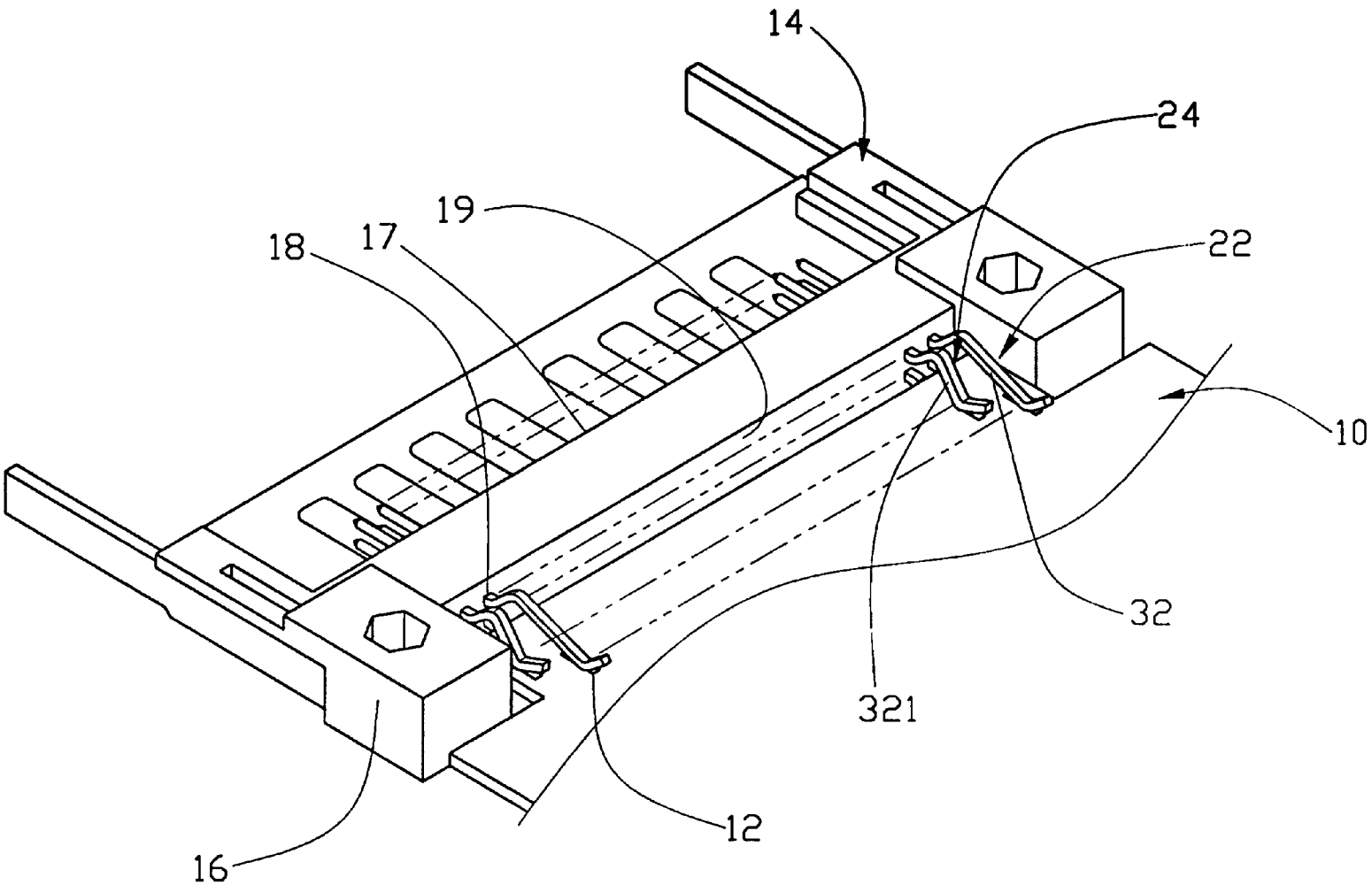
FIG. 3B is a perspective view of the electrical connector and PCB after assembly.

Referring to FIG. 1, an electrical connector 14 in accordance with a first embodiment of the present invention comprises an insulative housing 16 having a mating face 19 and an opposite rear face 17 and defining a plurality of passageways 18 therebetween. A plurality of conductive terminals 20 is received in the corresponding passageways 18. The terminals 20 are arranged in upper and lower rows whereby each row is arranged with alternating long terminals 22 and short terminals 24. In addition, each long terminal 22 of one row is paired with a short terminal 24 of the other row one above the other in columns. Referring to FIGS. 2A, 2B, 3A, and 3B, each terminal 20 has a contact section 26 (261), a securing section 36 (361) and a joint section 38 (381). Each securing section 36 (361) is received in the corresponding passageway 18, each joint section 38 (381) extends beyond the rear face 17 of the housing 16 for electrically connecting with a mating electrical card (not shown), and each contact section 26 (261) extends outward from the mating face 19 of the housing 16 for clippingly engaging with a printed circuit board (PCB) 10. A space (not labeled) is defined between the upper and lower rows of contact sections 26(261) whereby the PCB 10 is inserted into the space and retained therein due to a resilient engaging force of the terminals 20 acting thereon.

Each contact section 26 (261) of the terminals 20 is configured to have a first crook 28 (281) extending from the securing section 36 (361), a connecting section 32 (321) extending from the first crook 28 (281), and a second or contact crook 30 for electrically connecting with a contact pad 12 provided at corresponding positions on the PCB 10. A soldering procedure is performed on the tips 34 (341) and the corresponding contact pads 12 to complete assembly of the PCB 10 and the electrical connector 14.

Figure 4:
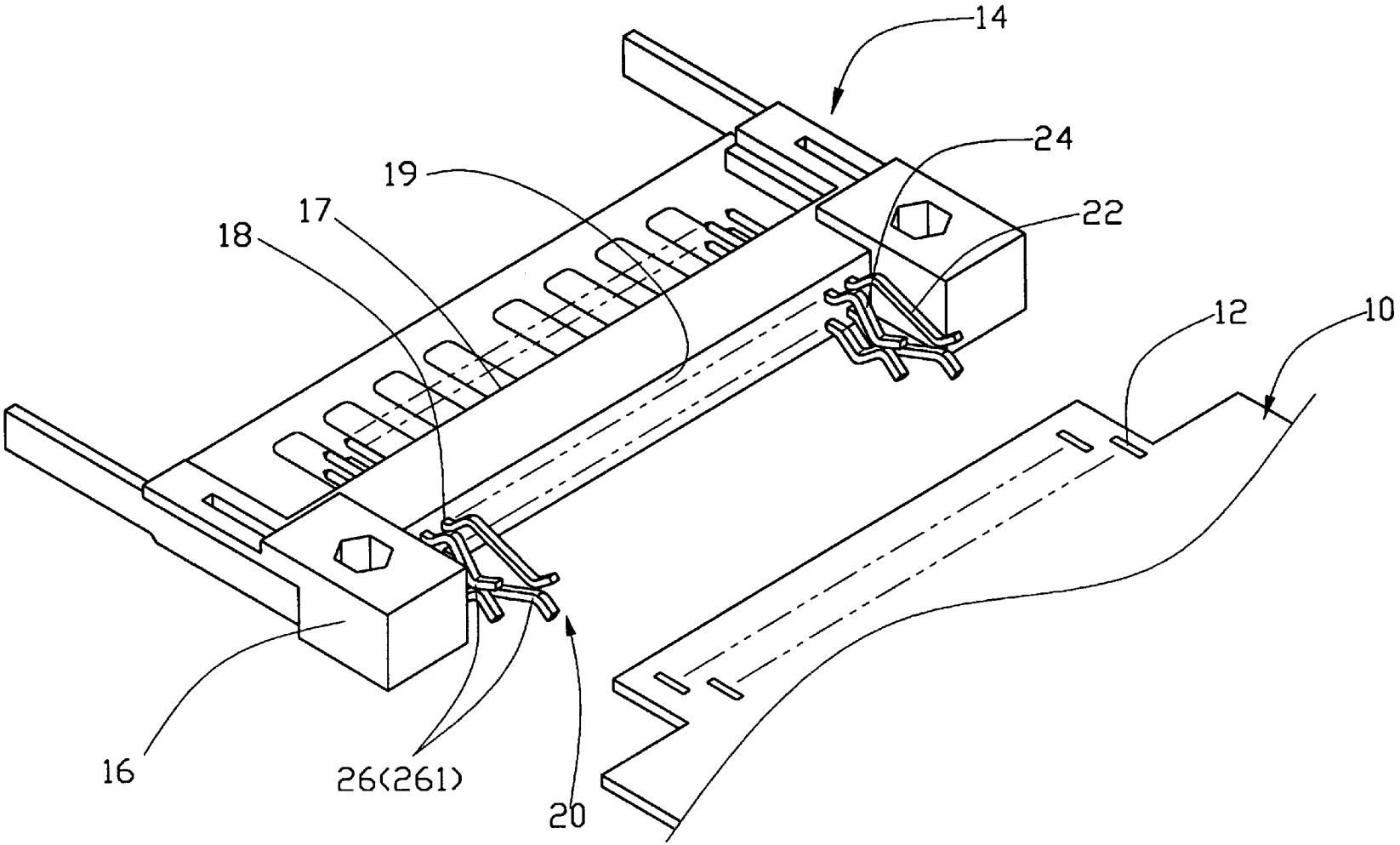
FIG. 4 is a perspective view of an electrical connector in accordance with a second embodiment of the present invention and the PCB.

Referring to FIG. 4, which shows a second embodiment of the present invention, the electrical connector 14 comprises the same components as the first embodiment such as the housing 16 and a number of conductive terminals 20 including long terminals 22 and short terminals 24 each having contact section 26 (261), securing section 36 (361) and joint section 38 (381). The contact sections 26 (261), comprise a first crook 28 (281) connected to a second crook 30 (301) by means of a connecting section 32 (321). Furthermore, the terminals 20 are aligned in upper and lower rows wherein the long terminals 22 are alternately arranged with the short terminals 24 in each row. However, unlike the first embodiment, each long terminal 22 of one row is paired in columns with a long terminal 22 in the other row. Likewise, each short terminal 24 of one row is paired in columns with a short terminal of the other row.

The design fundamentals of the second embodiment are the same as in the first embodiment. The configuration of each terminal 20 and the engagement between the PCB 10 and the electrical connector 14 are virtually identical. The only significant difference between the two embodiments lies in the arrangement of the terminals 20 within the housing 14 as described above. Hence, a further detailed description of the second embodiment is omitted herein.

Furthermore, the terminals 20 can also be arranged in other layouts not specified by the first and second embodiments. For example, terminals of the upper row can all be long terminals and terminals of the lower row can all be short terminals. This layout enables the PCB to mechanically contact the terminals of the upper row and the lower row at different times, thereby reducing mating resistance during assembly of the electrical connector to the PCB. Thus, it is to be understood that the present invention includes all embodiments available which provide contact between a PCB and an electrical connector at different times in accordance with the appended claims below.

It is to be further understood that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

an insulative housing having a mating face for abutting an end edge of a printed circuit board and a plurality of passageways extending from the mating face to a rear face opposite the mating face; and a plurality of conductive terminals each received in a corresponding passageway, said terminals each having a contact section, a securing section and a joint section, the securing sections being received in corresponding passageways, the joint sections extending out of the rear face opposite the mating face for electrically connecting with a mating electrical card, and the contact sections extending out of the mating face, said contact sections of said conductive terminals being arranged into at least an upper row and a lower row for clippingly engaging two opposite faces of a printed circuit board therebetween, each contact section having a contact crook, the contact crooks of two adjacent contact sections of each row being spaced a different distance from the mating face of the insulative housing.

2. The electrical connector as claimed in claim 1, wherein each said contact crook has a tip for electrically connecting with a printed circuit board.

3. The electrical connector as claimed in claim 1, wherein the contact crooks of the upper row contact sections align with the contact crooks of the lower row contact sections.

4. An electrical connector comprising:

an insulative housing defining a plurality of passageways therethrough, the housing defining a mating face for abutting against an edge of the printed circuit board and a rear face opposite the mating face, the passageways being arranged in an upper row and a lower row and extending through the housing from the mating face to the rear face; and an upper row of conductive terminals and a lower row of conductive terminals each being received in a corresponding passageway, each terminal row consisting of alternate long and short terminals, each terminal having a contact section extending out of the mating face of the housing for clippingly engaging with a printed circuit board and a joint section opposite the contact section of the terminal and extending out of the rear face of the housing for electrically connecting with a mating electrical card, the contact sections of the long terminals protruding a uniform distance from the mating face, the contact sections of the short terminals protruding a uniform, shorter distance from the mating face of the housing.

5. The electrical connector as claimed in claim 4, wherein said contact section of said conductive terminals comprises a first crook, a second crook and a connecting section jointing the first and second crooks, a tip being formed on the second crook for electrically connecting with a printed circuit board.

6. The electrical connector as claimed in claim 4, wherein each long terminal of one row is aligned in columns with a short terminal of the other row.

7. The electrical connector as claimed in claim 4, wherein each long terminal of one row is aligned in columns with a long terminal of the other row, and each short terminal of one row is aligned in columns with a short terminal of the other row.

8. The electrical connector as claimed in claim 4, wherein a space is defined between the contact sections of the upper and lower rows of terminals for entrance of the printed circuit board to be clippingly engaged by the contact sections.

9. The electrical connector as claimed in claim 1, wherein the joint sections each have a pin configuration.

10. The electrical connector as claimed in claim 4, wherein the joint sections each have a pin configuration.

* * * * *